US005097181A

United States Patent [19]

Kakitani

[11] Patent Number: 5,097,181

[45] Date of Patent: Mar. 17, 1992

[54] DISCHARGE LAMP LIGHTING DEVICE HAVING LEVEL SHIFT CONTROL FUNCTION

[75] Inventor: Tsutomu Kakitani, Yokohama, Japan

[73] Assignee: Toshiba Lighting & Technology Corporation, Tokyo, Japan

[21] Appl. No.: 588,619

[22] Filed: Sep. 26, 1990

[30] Foreign Application Priority Data

Sep. 29, 1989 [JP] Japan ..... 1-252334
Sep. 29, 1989 [JP] Japan ..... 1-252336

[51] Int. Cl.[5] ..... H05B 37/02

[52] U.S. Cl. ..... 315/209 R; 315/224; 315/DIG. 4

[58] Field of Search ..... 315/209 R, 212, 214, 315/219, 224, 287, 307, DIG. 4, DIG. 5

[56] References Cited

U.S. PATENT DOCUMENTS 4,641,065 2/1987 Munson ..... 315/209 R
4,684,850 8/1987 Stevens ..... 315/209 R
4,709,189 11/1987 Kuchii ..... 315/209 R
4,862,041 8/1989 Hirschmann ..... 315/DIG. 5
4,933,605 6/1990 Quazi ..... 315/DIG. 4
4,935,669 6/1990 Nilssen ..... 315/209 R

*Primary Examiner*—Eugene R. LaRoche
*Assistant Examiner*—A. Zarabian
*Attorney, Agent, or Firm*—Cushman, Darby & Cushman

[57] ABSTRACT

A discharge lamp lighting device includes a pair of main switching transistors and a feedback transformer. Each of the main switching transistors has a control electrode to form a push-pull circuit and which is switched on and off responsive to a given oscillating frequency. The feedback transformer has a pair of drive windings and serves to positively feed back the output of the push-pull circuit to each of the control electrodes of the paired main switching transistors. A first control circuit is connected to each of the bases of the main switching transistors and includes a variable impedance element to control the oscillating frequency by varying the impedance of this variable impedance element. A second control circuit has a level shift circuit and serves to control the level of signal applied to the first control circuit so as to change the impedance of the variable impedance element so that the on-off operation of each of the paired main switching transistors can be controlled.

8 Claims, 8 Drawing Sheets

FIG. 5A
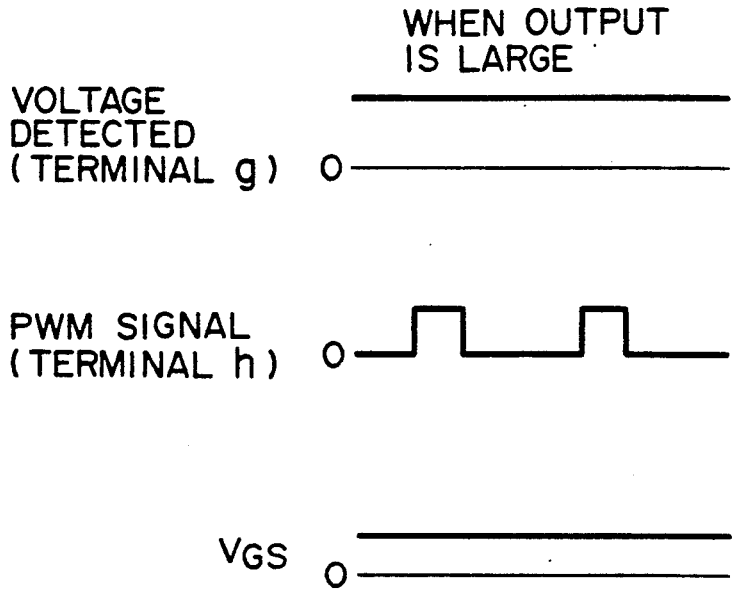
FIG. 5B
FIG. 5C
FIG. 6A
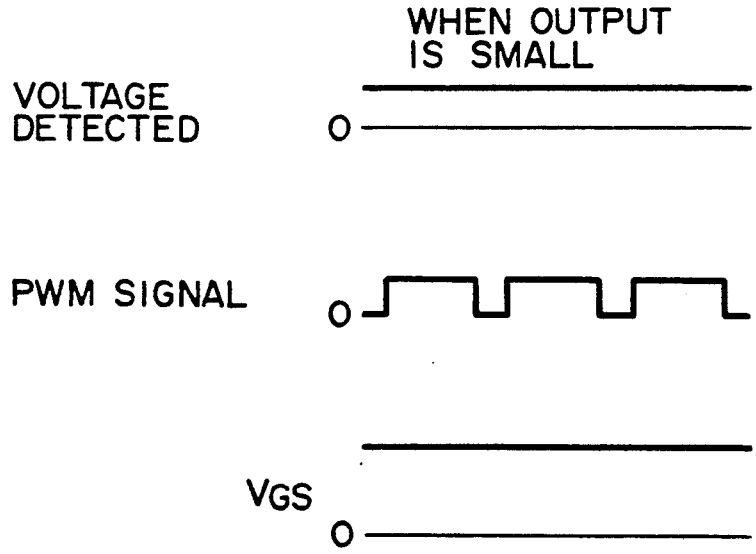
FIG. 6B
FIG. 6C

DISCHARGE LAMP LIGHTING DEVICE HAVING LEVEL SHIFT CONTROL FUNCTION

BACKGROUND OF THE INVENTION

1. Field of the Invention

The present invention relates to a discharge lamp lighting device and, more particularly, a discharge lamp lighting device wherein the fluorescent discharge lamp is lit using a self-excited half bridge inverter.

2. Description of the Related Art

The conventional device for lighting the fluorescent discharge lamp uses a self-excited half bridge inverter wherein a pair of main switching transistors are employed to form a single ended push-pull circuit. This inverter uses a feedback transformer wherein an output current applied from the inverter is detected by the transformer and this detected output is fed back to the base of each of the main switching transistors of the inverter from a secondary winding of the transformer so that the main switching transistors can be alternately switched on and off responsive to the output detected.

FIG. 1 shows an example of the conventional discharge lamp lighting device in which the above-described inverter is used.

In order to control the dimming of the discharge lamp or to stabilize the light output of the discharge lamp, switching times at which main switching transistors Q1*a* and Q1*b* are switched on and off are controlled so as to control the frequency of oscillation. This is achieved by changing time constants of the time constant circuits which comprise condensers C2*a*, C2*b* and resistors R2*a*, R2*b* by means of a variable impedance element or the like.

In the case of the inverter of the above-described type, a potential difference exists between a transistor drive section for one of the paired main switching transistors and another drive section for the other transistor. Namely, potentials (d) and (e) at bases of the main switching transistors Q1*a* and Q1*b* are different from each other in the circuit shown in FIG. 1. This prevents time constant control from being simultaneously carried out relative to both transistors Q1*a* and Q1*b*. Therefore, photo-couplers PCa, PCb or a transformer is used as an electrical insulating means to carry out the time constant control relative to both transistors. However, these components are so expensive as to make the device expensive.

In addition, it is difficult to control the output of the self-excited half bridge inverter over a wide range.

SUMMARY OF THE INVENTION

A first object of the present invention is to provide a discharge lamp lighting device low in cost and simple in circuit arrangement, but capable of being easily made as an integrated circuit.

A second object of the present invention is to provide a discharge lamp lighting device whose output can be controlled over a wide range.

These and other objects of the present invention can be achieved by a discharge lamp lighting device comprising a pair of main switching transistors having control electrodes to form a push-pull circuit and switched on and off responsive to a given oscillating frequency; a feedback transformer having a pair of drive windings and serving to positively feed back the output of the push-pull circuit to the control electrodes of the paired main switching transistors; a first control means connected to each of the bases of the paired main switching transistors, provided with a variable impedance element and serving to control the given oscillating frequency by varying the impedance of the variable impedance element; and a second control means connected to the first control means, provided with a level shift circuit and serving to control the level of signal applied to the first control means to change the impedance of the variable impedance element so that the on-off operation of the paired switching transistors can be controlled.

BRIEF DESCRIPTION OF THE DRAWINGS

The accompanying drawings, which are incorporated in and constitute a part of the specification, illustrate presently preferred embodiments of the invention, and together with the general description given above and the detailed description of the preferred embodiments given below, serve to explain the principles of the invention.

FIGS. 5A through 5C show waveforms at terminals of the circuit shown in FIG. 1 when output is large;

FIGS. 6A through 6C show waveforms at terminals of the circuit shown in FIG. 1 when output is small;

DETAILED DESCRIPTION OF THE PREFERRED EMBODIMENTS

Figure 1:
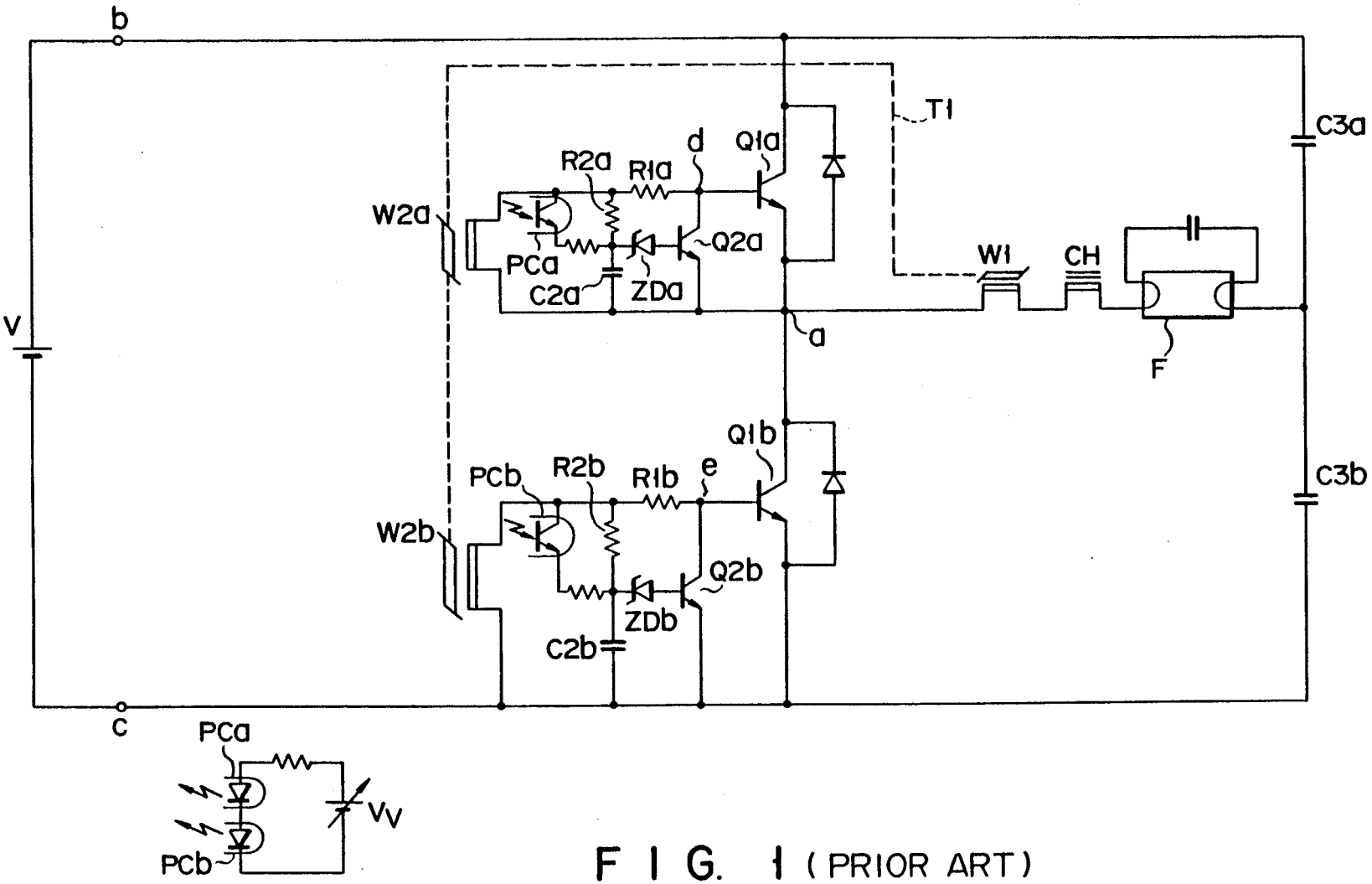
FIG. 1 (PRIOR ART)
FIG. 1 is a circuit arrangement showing the conventional discharge lamp lighting device.
Figure 2:
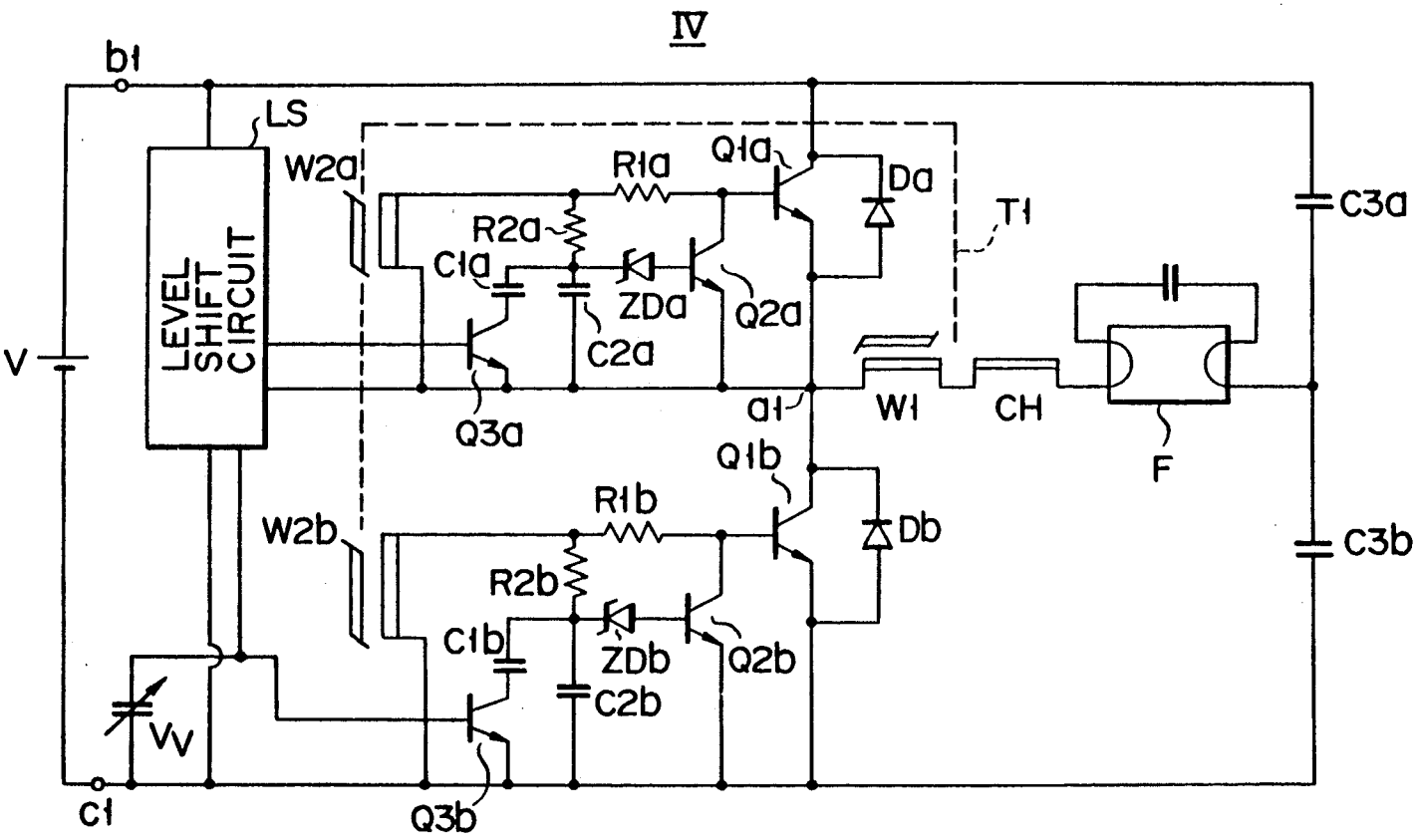
FIG. 2 is a circuit arrangement showing a first example of the discharge lamp lighting device according to the present invention.

A first example of the discharge lamp lighting device according to the present invention will be described with reference to the drawings. FIG. 2 shows a circuit arrangement for the first example of the discharge lamp lighting device according to the present invention. In the case of the discharge lamp lighting device shown in FIG. 2, output from a DC power source V is supplied to a series inverter circuit IV which comprises main switching transistors Q1*a* and Q1*b*, and it is inverted there to high frequency current to light a fluorescent lamp F which is connected to the output terminal of the series inverter circuit IV.

A transformer T1 is of the feedback type having a primary winding W1 and two secondary windings W2*a* and W2*b* which are wound counter to each other. The primary winding W1 is connected in series to an output terminal a1 of the inverter circuit IV, serving to detect load current flowing through the output terminal a1 and to generate in the secondary windings W2*a* and W2*b* those secondary voltages which correspond to the load current and whose phases are opposite to each other. The base of the main switching transistor Q1*a* is connected to the secondary winding W2*a* through a base current limiting resistance R1*a*. Similarly, the base of the main switching transistor Q1*b* is connected to the secondary winding W2*b* through a base current limiting resistor R1*b*. The base and emitter of an auxiliary transistor Q2*a* are connected to both ends of the secondary winding W2*a* via a resistor R2*a* and a Zener diode ZDa and the collector of this auxiliary transistor Q2*a* is connected to the base of the main switching transistor Q1*a*. Similarly, the base and emitter of an auxiliary transistor Q2*b* are connected to both ends of the other secondary winding W2*b* via a resistor R2 and a Zener diode ZDb, and the collector of this auxiliary transistor Q2*b* is connected to the base of the main switching transistor Q1*b*. C2*a* and C2*b* represent condensers which cooperate with the resistances R2*a* and R2*b* to form integration circuits (or CR time constant circuits for controlling those times at which the auxiliary transistors Q2*a* and Q2*b* are operative).

The fluorescent lamp F is connected to the output terminal a1 through a choke coil CH and also to the center of that line which connects condensers C3*a* and C3*b*.

A condenser C1*a* and a transistor Q3*a* which serves as a variable impedance element are connected parallel to the condenser C2*a* to the CR time constant circuit which comprises the resistance R2*a* and the condenser C2*a*. Similarly, a condenser C1*b* and a transistor Q3*b* are connected parallel to the condenser C2*b* to the other CR time constant circuit. A level shift circuit LS and a power source Vv whose voltage can be changed are connected to the DC power source V. The base of the transistor Q3*a* is connected to the level shift circuit LS while the base of the transistor Q3*b* is connected to the power source Vv.

This lighting device starts its oscillation responsive to a starting circuit (not shown) and continues its oscillation, alternately switching on and off the main switching transistors Q1*a* and Q1*b*. It is assumed that the main switching transistor Q1*a* has been switched on. Current supplied from the power source V now flows through a DC terminal b1, the transistor Q1*a*, primary winding W1 of the transformer T1, choke coil CH, lamp F, condenser C3*b* and a DC terminal c1. Current flowing through the primary winding W1 of the transformer T1 is positively fed back to the drive winding W2*a*, and the transistor Q1*a* is held conductive because the base current of this transistor Q1*a* is supplied to the primary winding W1. While the conductivity of the transistor Q1*a* is maintained, the current flowing through the primary winding W1 of the transformer T1 increases as time goes by, and the feedback voltages appearing at both ends of the secondary winding W2*a* gradually increase.

Responsive to a certain time constant determined by the CR time constant circuit which comprises the resistor R2*a* and condenser C2*a* and by the condenser C1*a* and transistor Q3*a* which serves as the means for changing the time constant of the CR time constant circuit, the Zener diode ZDa is activated to supply a base current to the auxiliary transistor Q2*a*. The auxiliary transistor Q2*a* is thus operated to switch off the main switching transistor Q1*a*.

Therefore, current flowing through the primary winding W1 of the transformer T1 or magnetomotive force relative to the core of the transformer T1 decreases quickly, and a positive voltage is excited in the drive winding W2*b* to switch the main switching transistor Q1*b* on. This on-state of the transistor Q1*b* is kept until the auxiliary transistor Q2*b* is activated in response to the certain time constant as described above. The main switching transistors Q1*a* and Q1*b* are alternately switched in this manner to keep the inverter oscillating.

In order to control the dimming of the discharge lamp in the case of this discharge lamp lighting device, those timings at which the auxiliary transistors Q2*a* and Q2*b* are switched on are controlled. To meet this purpose, this example includes the condenser C1*a* (or C1*b*) and transistor Q3*a* (or Q3*b*) which serves as the variable impedance element connected to the CR time constant circuit which comprises the resistor R2*a* (or R2*b*) and condenser C2*a* (or C2*b*) so as to control the timing at which the Zener diode ZDa (or ZDb) is made conductive. A certain voltage is applied from the variable DC power source Vv to the base and emitter of the transistor Q3*b*, and the same voltage is also applied from the level shift circuit LS to the transistor Q3*a*. Therefore, the time constant which is determined by the resistor R2*a*, condensers C2*a*, C1*a* and transistor Q3*a* of the upper circuit in FIG. 2 is made same as that determined by the resistor R2*b*, condensers C2*b*, C1*b* and transistor Q3*b* of the lower circuit in FIG. 2. This time constant can be changed by varying the variable DC power source Vv. The inverter output can be thus controlled to dim the discharge lamp.

Figure 3:
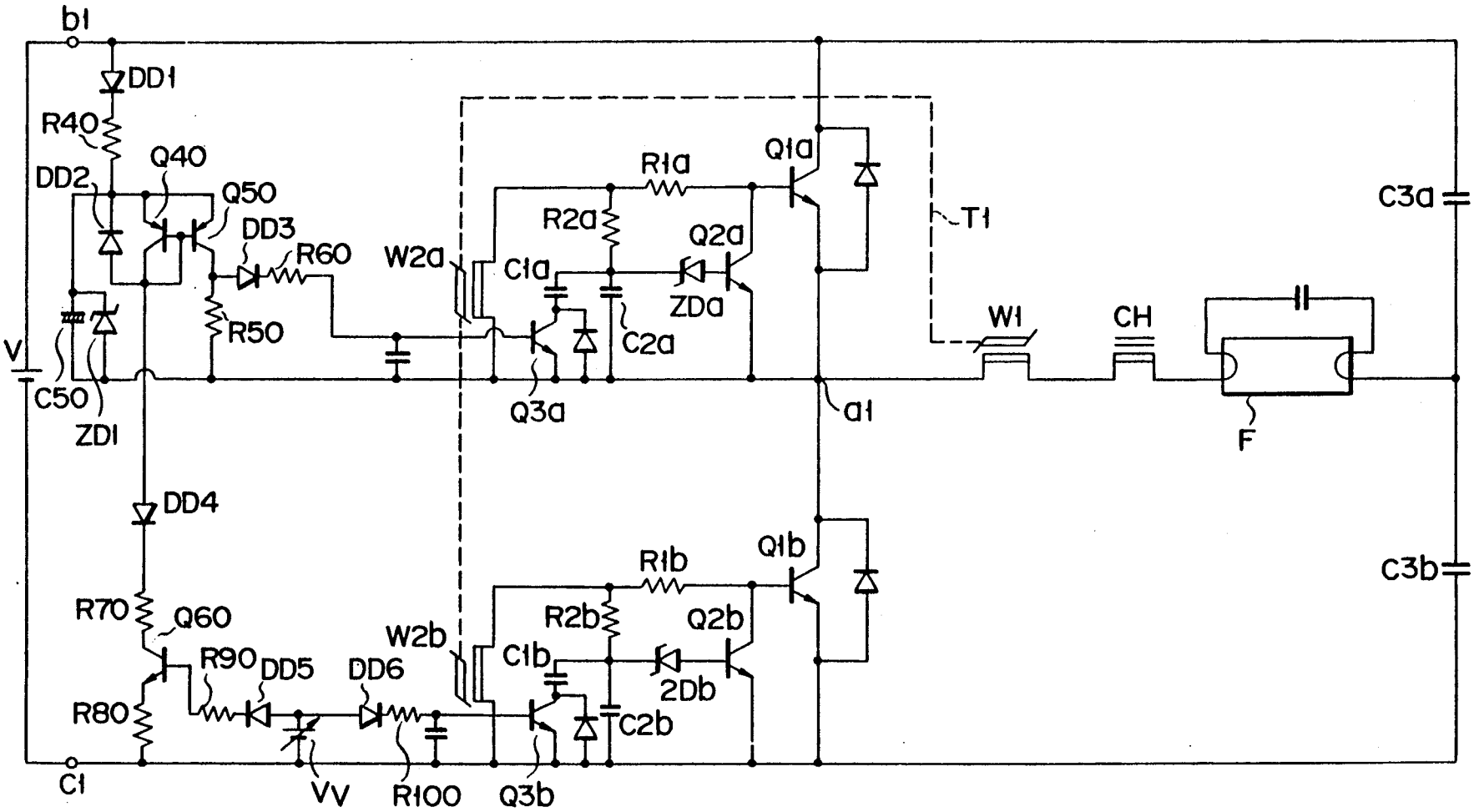
FIG. 3 is a variation of the circuit arrangement showing the first example of the discharge lamp lighting device in which the level shift circuit shown in FIG. 2 is replaced by a current mirror circuit.

FIG. 3 shows a circuit diagram of the discharge lamp lighting device according to the present invention in which the level shift circuit in FIG. 2 is replaced by a current mirror circuit. Those components denoted by the same reference numerals as in FIG. 2 serve the same functions as they do in FIG. 2, and a description of these components will be omitted.

The emitters of the two transistors Q40 and Q50 which form the current mirror circuit are connected to the DC terminal b1 through a diode DD1 and resistor R40. The collector of the transistor R50 is connected to the terminal a1 via a resistor R50 to convert collector current to voltage. The collector of the transistor Q50 is connected to the base of the transistor Q3*a* which serves as the variable impedance element via a diode DD3 and a resistor R60.

The collector of the other transistor Q40 which is a component of the current mirror circuit is connected to the collector of a transistor Q60 via a diode DD4 and a resistor R70. The emitter of the transistor Q60 is connected to a terminal c1 via a resistor R80. Base current is supplied from the variable DC power source Vv to the base of the transistor Q60 through a diode DD5 and a resistor R90. Base current is also supplied from the variable DC power source Vv to the base of the transistor Q3*b* which serves as the variable impedance element via a diode DD6 and a resistor R100. A condenser C50 and a Zener diode ZD1 are arranged to form a power source.

When the voltage of the variable power source Vv is changed in the case of a discharge lamp lighting device as described above, a certain base current which depends upon the changed voltage of the power source is supplied to the transistor Q3*b* of the lower circuit in FIG. 3. On the other hand, the base current of the transistor Q60 can be changed by varying the voltage of the variable power source Vv. Therefore, a certain current can be applied from the transistor Q40 to the transistor Q60 via the diode DD4 and resistor R70. The same amount of current as that flowing to the transistor Q40 is allowed to flow to the transistor Q50 by the current mirror circuit which comprises transistors Q40 and Q50. When resistor R50 and R60 are set to have certain values, therefore, the same amount of base current as that supplied to the transistor Q3*b* can be supplied to the transistor Q3*a*. As is apparent from the above, the impedances of the transistors Q3*a* and Q3*b*, which serve as variable impedance elements, can be changed by varying the variable DC power source Vv. Time constants of the upper and lower circuits in FIG. 3 can thus be changed in the same manner so as to control the output of the inverter.

According to the first example of the discharge lamp lighting device arranged as described above, time constants of the CR time constant circuits, each connected to the drive circuit for each of the paired main switching transistors, can be changed using the level shift circuit. This makes it unnecessary to use such electrical insulating means as transistors and photocouplers, allowing the inverter to be formed cheaply. In addition, this discharge lamp lighting device is more suitable for integrated circuits.

Figure 4:
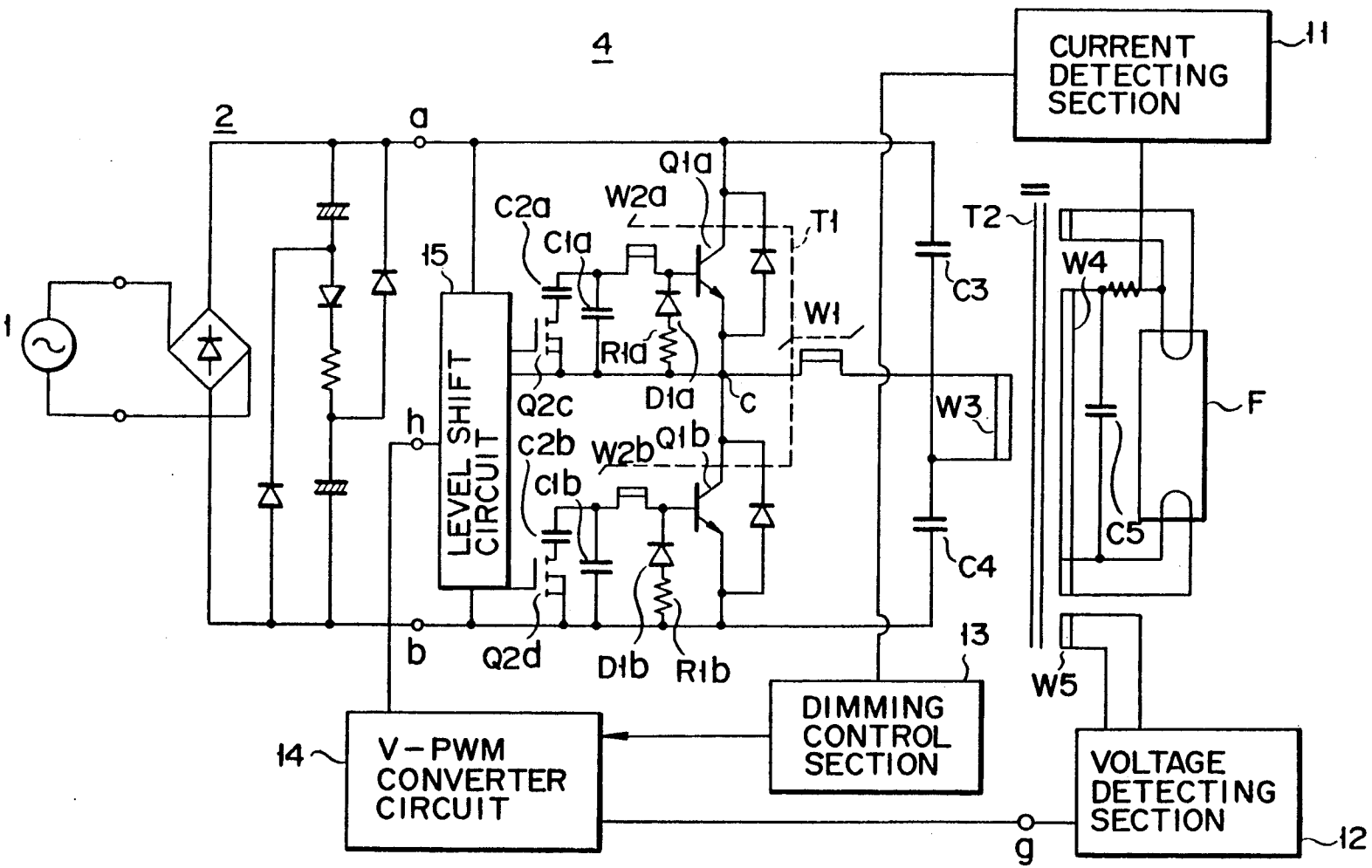
FIG. 4 is a circuit arrangement showing a second example of the discharge lamp lighting device according to the present invention.

FIG. 4 shows a circuit diagram for a second example of the discharge lamp lighting device according to the present invention. Reference numeral 1 represents an AC power source and 2 a DC smoothing circuit by which DC voltage is generated between DC terminals (a) and (b). Q1*a* and Q1*b* denote main switching transistors which form a series inverter 4, T1 a supersaturated transformer (or current transformer former of the supersaturated type) for driving gates (or control electrodes) of the main switching transistors Q1*a* and Q1*b*, T2 an inverter transformer (or output transformer), and F a discharge lamp such as a fluorescent lamp.

The transformer T1 is of the feedback type, having a primary winding W1 and two secondary windings W2*a* and W2*b* which are wound counter to each other. The primary winding W1 is connected to an output terminal (c) to detect the load current flowing through the output terminal (c) so as to generate in the secondary windings W2*a* and W2*b* those secondary voltages which correspond to the load current detected and whose phase are opposite to each other. The bases of the main switching transistors Q1*a* and Q1*b* are respectively connected to one end of each of the secondary windings W2*a* and W2*b*, while condensers C1*a* and C1*b*, which determine frequency oscillation, are respectively connected to the other ends of the secondary windings W2*a* and W2*b*. The other ends of the condensers C1*a* and C1*b* are connected to the emitters of the switching transistors Q1*a* and Q1*b*. Diodes D1*a*, D1*b* and resistors R1*a*, R1*b* are respectively inserted between those junction points at which the bases of the switching transistors Q1*a*, Q1*b* are connected to the secondary windings W2*a*, W2*b* of the transformer T1, and the emitters of the switching transistors Q1*a*, Q1*b*.

Condensers C2*a*, C2*b* and FETs Q2*c*, Q2*d*, which serve as variable impedance elements, are connected in parallel to condensers C1*a* and C1*b*. Voltage $V_{GS}$ is applied from a level shift circuit 15 to gates and sources of FETs Q2*c* and Q2*d*.

Reference numeral 11 represents a section for detecting lamp current, 12 a section for detecting lamp voltage and 13 a section for controlling the dimming of the lamp. Responsive to outputs of these sections 11, 12 and 13, a V-PWM converter circuit 14 generates signal PWM which has a predetermined pulse width, and supplies it to the level shift circuit 15, which applies a voltage corresponding to the pulse width of this PWM signal to the FETs Q2*c* and Q2*d* as voltage $V_{GS}$ appearing between bases and sources of these FETs Q2*c* and Q2*d*.

The inverter transformer T2 has the current detecting winding W1 of the transformer T1, a primary winding W3 inserted between the junction point (c) of the switching transistors Q1*a* and Q1*b* and the DC terminals (a), (b) via condensers C3 and C4, and a secondary winding W4 connected to the lamp F as the output winding of this inverter. The transformer T2 also has a secondary winding for supplying current to the filament of the lamp F, and a tap. The voltage detecting section 12 is provided with a secondary winding W5 for detecting lamp voltage. The frequency oscillated by this inverter is determined by the resonating frequency determined by the capacitance of a condenser C5 and the leakage inductance of the inverter transformer T2 and by the saturated flux density of the super-saturated transformer T1.

When the AC power source 1 is switched on to generate full wave rectification smoothing DC output at the DC output terminals (a) and (b) and the inverter is started by the starting circuit (not shown), the main switching transistors Q1*a* and Q1*b* are alternately switched to maintain oscillation.

It is assumed that the main switching transistor Q1*a* is switched on. The current supplied at this time flows through the DC terminal (a), main switching transistor Q1*a*, current detecting winding W1 of the transformer T1, primary winding W3 of the transformer T2, condenser C4 and DC terminal (b). Current flowing through the current detecting winding W1 is positively fed back to the drive winding W2*a*, and the conductivity of the main switching transistor Q1*a* is maintained. While this main switching transistor Q1*a* is held operative, current flowing through the current detecting winding W1 increases with time, and the flux density in the core of the supersaturated transformer T1 is increased and finally saturates the transformer T1.

This causes the exciting voltage of the drive winding W2*a* to become zero and the main switching transistor Q1*a* is thus switched off. Therefore, current flowing through the current detecting winding W1, or magnetomotive force relative to the core of the transformer T1, decreases quickly and when this magnetomotive force falls below the level required to magnetically saturate the core of the transformer T1, positive voltage is excited in the drive winding W2*b* to switch on the main switching transistor Q1*b*. This on-state of the main switching transistor Q1*b* is maintained until the transformer T1 is saturated by current positively fed back through the current detecting and drive windings W1 and W2*b*. Thereafter, the main switching transistors Q1*a* and Q1*b* are alternately switched as described above to keep the inverter oscillating.

The primary winding W3 of the inverter transformer T2 is AC-driven by this oscillation and AC voltage is excited in the secondary winding W4. When this secondarily excited output is supplied to the lamp F, which is the load, the lamp F is lit.

The current detecting section 11 is intended to detect and control the lamp current, and the voltage detecting section 12 is intended to detect and control the lamp voltage. The section 1 is intended to dim the lamp F. These detection and dimming outputs are applied to the V-PWM converter circuit 14. The V-PWM converter circuit 14 applies a PWM signal, which has such a pulse width corresponding to that of the detection output, to the level shift circuit 15. The level shift circuit 15 supplies voltage $V_{GS}$ between the gate and source of the condenser control FETs Q2*c* and Q2*d* responsive to the pulse width of the PWM signal applied. The capacities of the condensers connected to the bases of the main switching transistors Q1*a* and Q1*b* are thus determined and the frequency oscillated by the inverter is also determined.

FIGS. 5A through 6C show the waveforms of signals at the terminals to tell how inverter output is controlled when detection output applied from the voltage detecting section 12 is large and small. When the voltage detected by the voltage detection section 12 is high (or voltage at terminal (g) is high) as shown in FIG. 5A, the V-PWM converter circuit 14 applies a PWM signal, whose pulse width is relatively narrow as shown in FIG. 5B, to a terminal (h). The level shift circuit 15 sets voltage $V_{GS}$, which is applied between the gate and source of the condenser control FETs Q2*c* and Q2*d*, relatively low in response to the pulse width of the PWM signal (FIG. 5C). The impedances of the FETs Q2*c* and Q2*d* are thus increased, the capacity of the condensers of the base drive circuit of the main switching transistors Q1*a* and Q1*b* is reduced and the frequency oscillated by the inverter becomes high. The frequency oscillated by the inverter is set higher than the resonance frequency of the load circuit in the case of this discharge lamp lighting device. When the frequency oscillated becomes high, therefore, inverter output becomes low and lamp voltage is thus lowered.

When the voltage detected by the voltage detecting section 12 is low, as shown in FIG. 6A, the V-PWM converter circuit 14 applies the PWM signal, whose pulse width is relatively wide in response to the voltage detected, to the level shift circuit 15 (FIG. 6B). Responsive to this PWM signal applied, the level shift circuit 15 sets voltage $V_{GS}$, which is applied between the gate and source of the condenser control FETs W2*c* and Q2*d*, relatively high. Therefore, the frequency oscillated becomes low and inverter output is increased, thus the lamp voltage becomes accordingly high.

Inverter output is similarly determined in cases of current detection and dimming control.

Figure 7:
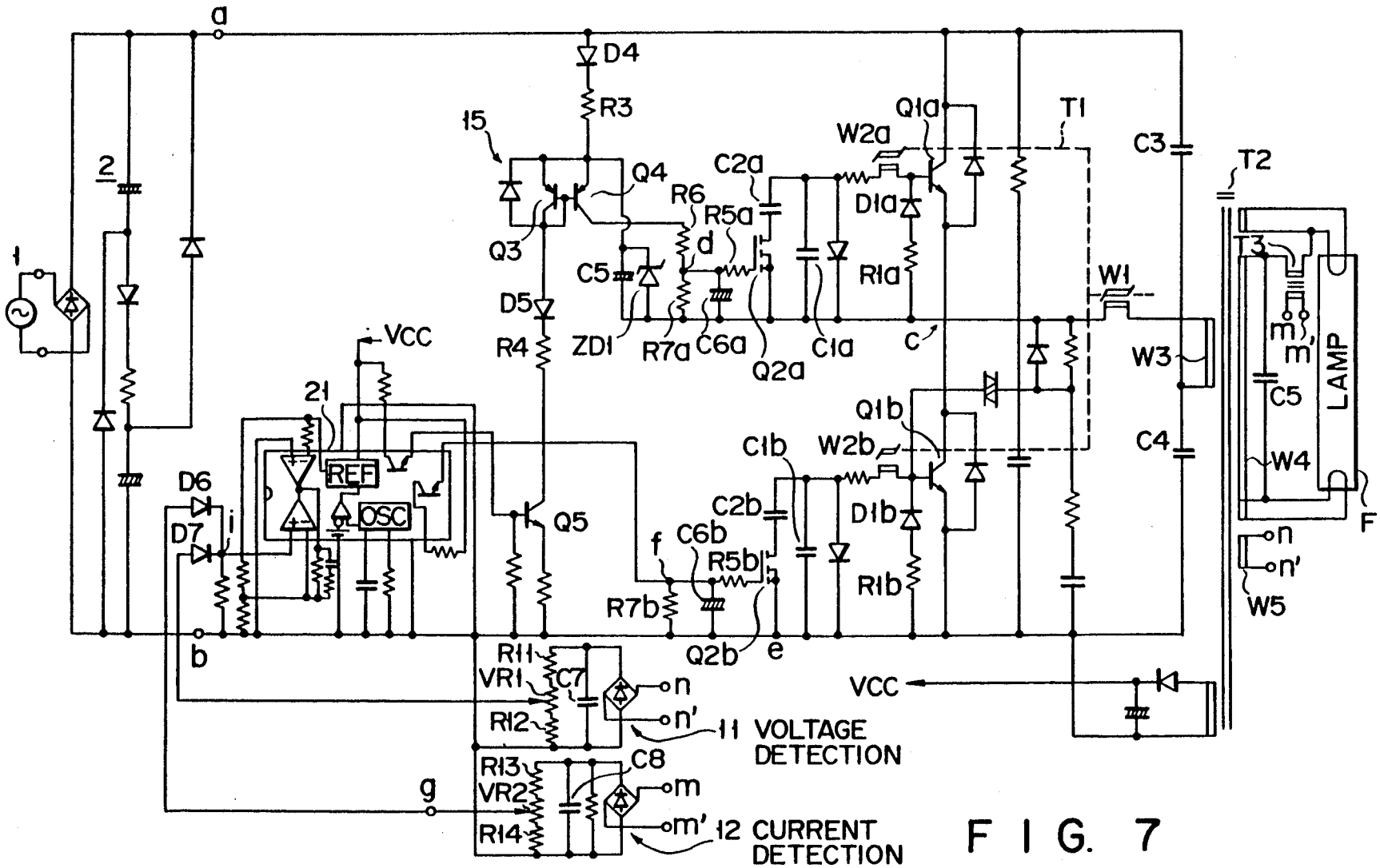
FIG. 7 is the circuit arrangement showing the second example of the discharge lamp lighting device in which circuits such as the level shift circuit shown in FIG. 4 are shown in more detail.

FIG. 7 shows a circuit diagram in which the level shift and V-PWM converter circuits 15 and 14 in FIG. 4 are shown in more detail. Those components which are denoted by the same reference numerals as in FIG. 4 serve the same functions, and a description on these components will be omitted.

Secondary voltages generated in the secondary windings (or terminals m and m') of the transformer T3 for detecting lamp current are rectified by the rectifier circuit and applied to a resistance R13, a variable resistor VR2 and a resistor R14. They are thus divided by these resistors and applied to a terminal I of an IC 21 via a terminal (g) and a diode 6.

On the other hand, lamp voltage detected by a secondary winding W5 of the transformer T2 is similarly rectified and applied to a resistor R11, a variable resistor VR1 and a resistor R12. It is then applied to a terminal (i) of the IC 21 via the variable resistor VR1 and a diode D7.

Variable resistors VR1 and VR2 are intended to adjust the level at which voltage and current are detected.

The IC 21 is of TL494 type and forms the V-PWM converter circuit. The IC 21 applies a PWM signal, whose pulse width corresponds to the DC voltage applied to its input terminal (i), to the base of a transistor Q5 and similarly to a terminal (f).

The PWM signal applied to the terminal (f) is converted to DC voltage by a CR circuit which comprises a resistor R7*b* and a condenser C6*b*, and is applied between the gate and source of the FETQ2*b* via a resistor R5*b*. On the other hand the transistor Q5 is switched on and off responsive to the PW signal applied to its base and when it is switched on, a certain value of current flows from one Q3 of those transistors which form the current mirror circuit to the transistor Q5 through a diode D5 and a resistor R4. A current having the same value as that of the above current flows to the other Q4 of those transistors which form the current mirror circuit.

The current flowing to the transistor Q4 passes through, via a resistor R6, a terminal (d) where it is converted to DC voltage by a CR circuit which comprises a resistor R7*a* and a condenser C6*a*, and is applies between the gate and source of the FET Q2*c* via a resistor R5*a*. As a result, the same voltage $V_{GS}$ is applied to the upper and lower FET Q2*c* and Q2*d*, respectively.

As described above, the impedances of the FETs Q2*c* and Q2*d*, the oscillation frequencies of the switching transistors Q1*a* and Q1*b*, and the output of the inverter, are all changed.

Figure 8:
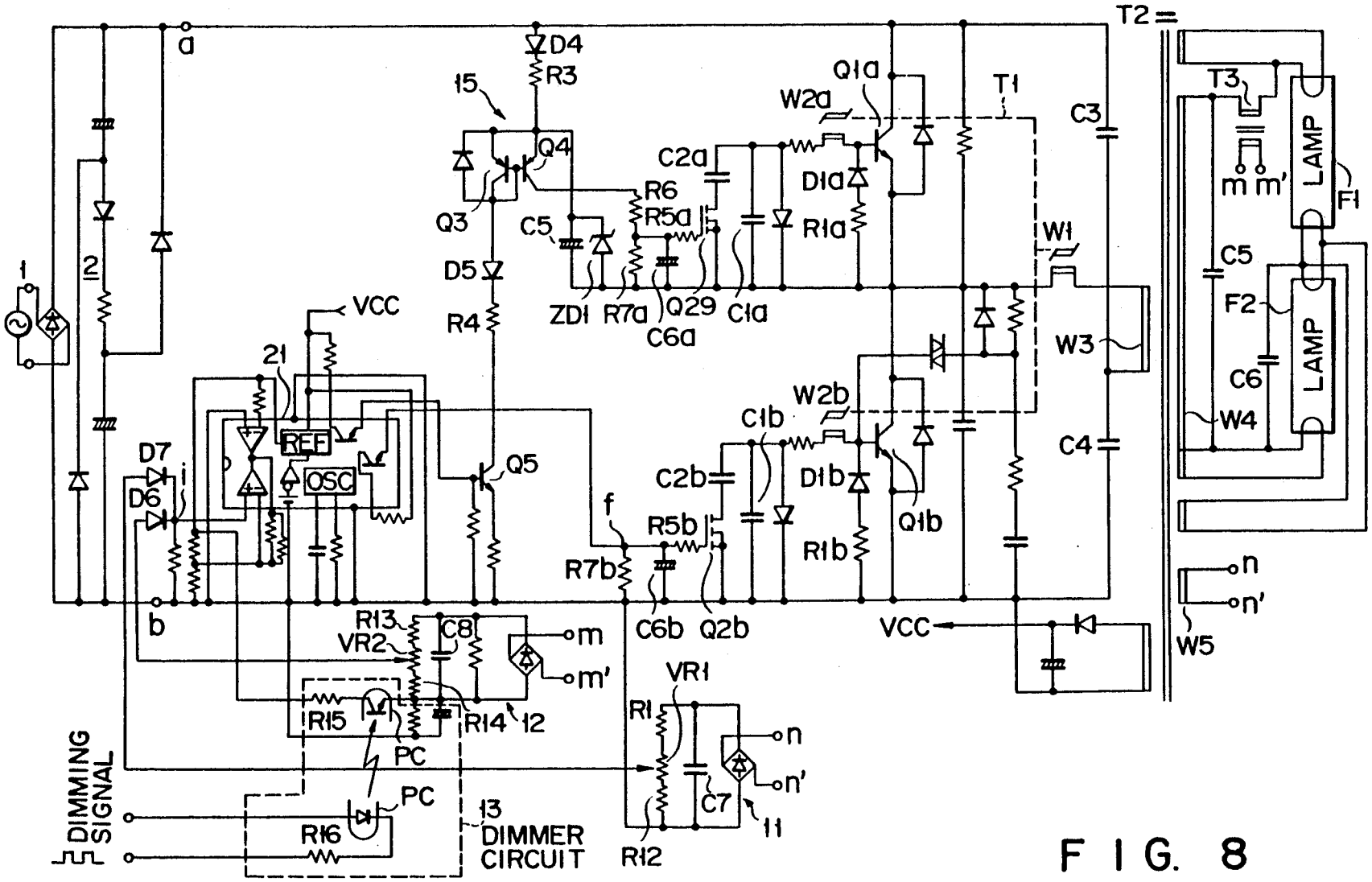
FIG. 8 is a circuit arrangement showing the discharge lamp lighting device in which a dimmer circuit is included.

FIG. 8 is a circuit diagram of the discharge lamp lighting device in which the lamp F in FIG. 7 is replaced by two lamps F1 and F2 and a dimmer circuit 13 is added. A pulse-like dimming signal is applied to the dimmer circuit to drive the primary side of a photocoupler PC through a resistor R16. The secondary side of the photocoupler PC is connected in series to one end of the current detecting section 12, together with a resistor R15.

When arranged in this manner, the amount of current detected is increased responsive to the pulse-like dimming signal and applied to the IC 21 which forms the V-PWM converter circuit. Inverter output is thus controlled responsive to the dimming signal and dimming control of the lamps can be achieved.

According to the second example of the discharge lamp lighting device as described above, a PWM signal is converted to DC voltage by the level shift circuit and the capacity of the condensers, which determine the frequency of the control circuit for the main switching transistors, is controlled by this DC voltage. The output of the self-excited half bridge inverter can be thus controlled over a wide range. In addition, the inverter is of the self-excited type and its drive circuit can be made simpler and cheaper as compared with those of the separately-excited type. Further, cheap bipolar transistors can be stably driven without using any power MOSFET, having a high withstanding voltage but high in cost and large in on-resistance (or resistance between drain and source). Furthermore, the bipolar transistors used has a high withstanding voltage, thereby making it possible to omit any protection circuit relative to foreign surges.

Figure 9:
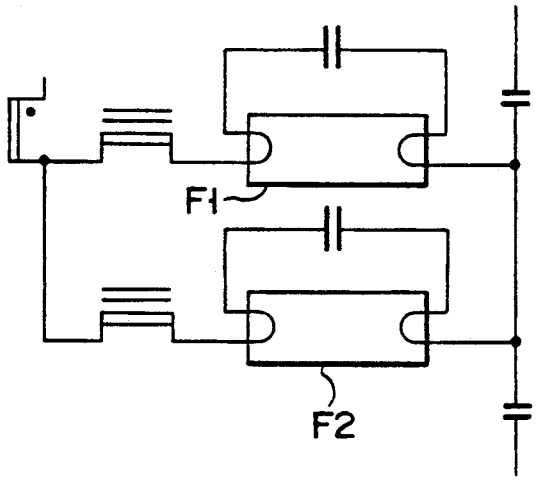
FIGS. 9 and 10 are circuit arrangements showing variations of the lamp section.
Figure 10:
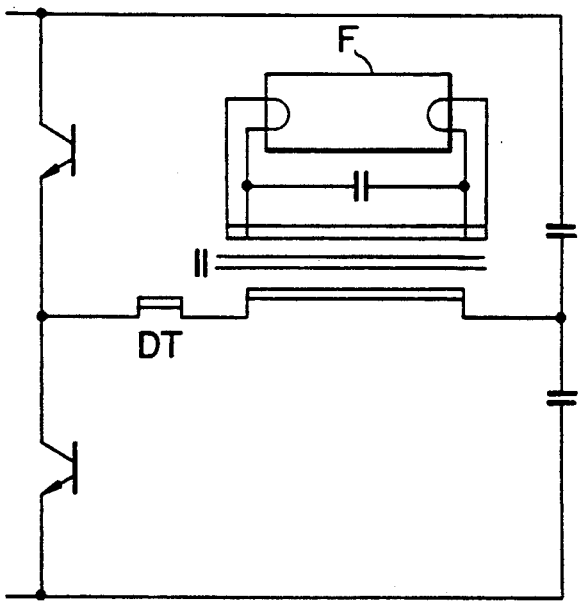

The present invention can be applied to plural lamps F1, F2 connected in parallel as shown in FIG. 9 and also to an insulating transformer as shown in FIG. 10.

Additional advantages and modifications will readily occur to those skilled in the art. Therefore, the invention in its broader aspects is not limited to the specific details, and representative devices, shown and described herein. Accordingly, various modifications may be without departing from the spirit or scope of the general inventive concept as defined by the appended claims and their equivalents.

What is claimed is:

1. A discharge lamp lighting device comprising:

a pair of main switching transistors each having a control electrode, the transistors being arranged to form a push-pull circuit, the transistors being switched on and off responsive to an oscillating signal;

a feedback transformer having a pair of drive windings, for positively feeding back the output of the push-pull circuit to each of the control electrodes of the paired main switching transistors;

a pair of time constant circuits connected to the bases of the paired main switching transistors for determining the times at which the paired main switching transistors are switched on;

a variable power source connected to the paired time constant circuits to supply a voltage to the paired time constant circuits, said voltage being variable to change the time constants of the paired time constant circuits; and a level shift circuit, coupled between the paired main switching transistors and the variable power source, for controlling the level of said voltage supplied from the variable power source so as to equalize the voltage supplied to each of the paired time constant circuits;

wherein the level shift circuit includes a current mirror circuit.

2. A discharge lamp lighting device comprising:

a pair of main switching transistors each having a control electrode, the transistors being arranged to form a push-pull circuit and switched on and off responsive to an oscillating signal;

a feedback transformer, having a pair of drive windings, for positively feeding back the output of the push-pull circuit to each of the control electrodes of the paired main switching transistors;

a detector means for detecting the outputs of the paired main switching transistors to generate detection outputs;

a pulse signal generator means for generating a pulse signal responsive to the detection outputs;

a variable impedance means having a variable impedance and connected to the paired main switching transistors for changing the oscillating signal frequency for the paired main switching transistors; and a level shift circuit for generating a DC voltage of a level which corresponds to the pulse width of the pulse signal and supplying this DC voltage to the variable impedance means to control said variable impedance.

3. The discharge lamp lighting device according to claim 2 wherein the level shift circuit includes a current mirror circuit.

4. The discharge lamp lighting device according to claim 2, further comprising a load connected to the paired main transistors, said load being a lamp means; wherein the detector means includes a section for detecting a current of the lamp means, a voltage of the lamp means, and a dimmer circuit for dimming the light of the lamp means.

5. The discharge lamp lighting device according to claim 4, wherein the lamp is formed by plural lamps connected in series to one another.

6. The discharge lamp lighting device according to claim 4, wherein the lamp is formed by plural lamps connected in parallel to one another.

7. The discharge lamp lighting device according to claim 2, wherein the variable impedance means includes an FET.

8. The discharge lamp lighting device according to claim 2, wherein the pulse generator means includes a V-PWM converter circuit for generating a pulse signal having a pulse width which corresponds to the detection outputs.

* * * * *